United States Patent [19]

Donohue

[11] Patent Number: 4,647,037

[45] Date of Patent: Mar. 3, 1987

[54] WEIGHTED JUMP ROPE HANDLE

[76] Inventor: James R. Donohue, 31921 Green Hill Dr., Castaic, Calif. 91310

[21] Appl. No.: 781,778

[22] Filed: Sep. 30, 1985

[51] Int. Cl.[4] ..... A63B 5/20

[52] U.S. Cl. ..... 272/75; 272/122

[58] Field of Search ..... 272/74, 75, 122, 143, 272/123, 117, 67, 68

[56] References Cited

U.S. PATENT DOCUMENTS

| | | | |
|---|---|---|---|
| 729,064 | 5/1903 | Hale | 272/122 X |
| 1,462,088 | 7/1923 | La Sares | 272/75 |
| 1,666,201 | 4/1928 | Goldstein | 272/75 |
| 2,719,038 | 9/1955 | Massa | 272/75 |
| 4,079,932 | 3/1978 | Schuetz | 272/75 |
| 4,157,827 | 6/1979 | Winston et al. | 272/75 |

FOREIGN PATENT DOCUMENTS

| | | | |
|---|---|---|---|
| 0149179 | 3/1955 | Sweden | 272/75 |
| 0017640 | of 1901 | United Kingdom | 272/122 |

*Primary Examiner*—Robert A. Hafer
*Assistant Examiner*—Kathleen J. D'Arrigo
*Attorney, Agent, or Firm*—Philip D. Junkins

[57] ABSTRACT

Variable weight jump or skip rope handles which have a handle grip member which is rotatably mounted on, and is axially aligned with, a centrally extending end-connect bar with end weight members of variable weight designation removably mounted on the ends of the end-connect bar adjacent to the ends of the grip member. A swivel connector is mounted on one of each pair of end weight members for attachment of each handle assembly to an end of a skip or jump rope.

4 Claims, 3 Drawing Figures

WEIGHTED JUMP ROPE HANDLE

BACKGROUND OF THE INVENTION

1. Field of the Invention

This invention relates to Jump ropes or skip ropes and more particularly to weighted jump rope and skip rope handles for the development of the muscular structure of the hand, wrist and forearm of the user.

2. Description of the Prior Art

Numerous disclosures of exercise weights may be found in the patent literature including the weights and equipment disclosed in U.S. Pat. Nos. 1,138,196; 1,366,200; 1,422,888; 1,917,566; 3,311,374; 3,334,899 and 3,756,597. Also, the prior art discloses designs for jumping or skipping ropes with weighted handles and U.S. Pat. Nos. 2,719,038 granted to S. Massa and 4,079,932 granted to R. W. Schuetz disclose skipping ropes having variable weight handles. The handle design of the Massa patent places substantially all of the handle weight and all of the additional or variable weights at the forward end (rope attaching end) of each grip handle. The Schuetz variable weight handle design includes a chamber filled with a measured quantity of water or other fluent material with such chamber disposed outwardly from the grip portion of the handle and thus outwardly of the gripping hand of the user. Although the Schuetz handle design provides small steps of weight adjustment over a weight range, it is difficult to balance or adjust the weight of the handles evenly without the use of a scale. Further, there is a fluid sloshing movement within the handles when the fluid chamber of each handle is not filled with the fluent material.

The foregoing prior art designs for skip rope or jump rope handles do not provide the advantages of the present invention in terms of weight balance in the user's hands and overall balance, convenience, safety and flexibility of use and application for the development of muscle structure and arm to leg coordination.

OBJECT OF THE INVENTION

It has been recognized that one who uses an ordinary jump rope does not increase the strength of his or her grip, nor is there development of the muscles associated with the hands, wrists and forearms. The purpose of a weighted-handle skip rope is to develop these elements of the arm and hand system while at the same time developing coordination between the leg and foot system and overall body endurance.

The principal object of the present invention is to provide improved, variable weight handles for jump or skip ropes which afford an improved balance of weight between the forward end (rope attaching end) of the handle grip section and the rearward end of the handle grip section of each handle.

It is a further object of the invention to provide an improved skipping rope exercising device including variable weight handles which afford adjustment of weight between the forward end (rope attaching end) of the handle grip section and the rearward end of the handle grip section of each handle.

Other objects and features of this invention will become apparent from the summary, detailed description and appended claims taken in conjunction with the accompanying drawings.

SUMMARY OF THE INVENTION

The above objectives are achieved by providing variable weight jump or skip rope handles which have a handle grip member which is rotatably mounted on, and is axially aligned with, a centrally extending end-connect bar with end weight members of variable weight designation removably mounted on the ends of the end-connect bar adjacent to the ends of the grip member. A swivel connector is mounted on one of each pair of end weight members for attachment of each handle assembly to an end of a skip or jump rope.

It is preferrable that the end weight members mounted to each end of the end-connect bar of the handle assembly be of equal weight so that each rope handle presents a balanced weight pattern between the forward end (rope attaching end) of the handle grip section and the rearward end of the handle grip section. By starting a skip rope exercise program with relatively light end weights the user is enabled to increase the size and strength of the hand, wrist and forearm muscles of each arm and hand system. By further incremental increases in the weight of each end weight member of each handle assembly the size and strength of the hand, wrist and forearm muscles increase together with the development of overall body endurance and exercise coordination. It is preferred to employ an orthopedic handle grip design in the handle assembly, i.e., a handle grip section that conforms to the palm and finger grip profile of the individual using the weighted skip or jump rope handles of the invention in his or her exercise program. An orthopedic handle grip design offers resistance to rotation of the grip surface in the user's hand and focuses the exercise activity to the muscles in the hand, wrist and forearm controlling the flexing of the wrist and not to gripping muscles. Also, a smooth handle grip section becomes slippery during the exercise program with the result that the gripping muscels receive the user's concern and focus. The uniformity of weight end-to-end in the handle assembly discourages rotation of the assembly in the hands of the user during the exercise program.

BRIEF DESCRIPTION OF THE DRAWING

The accompanying drawing sheet shows in its figures several embodiments of the present invention.

DESCRIPTION OF THE PREFERRED EMBODIMENTS

Figure 1:
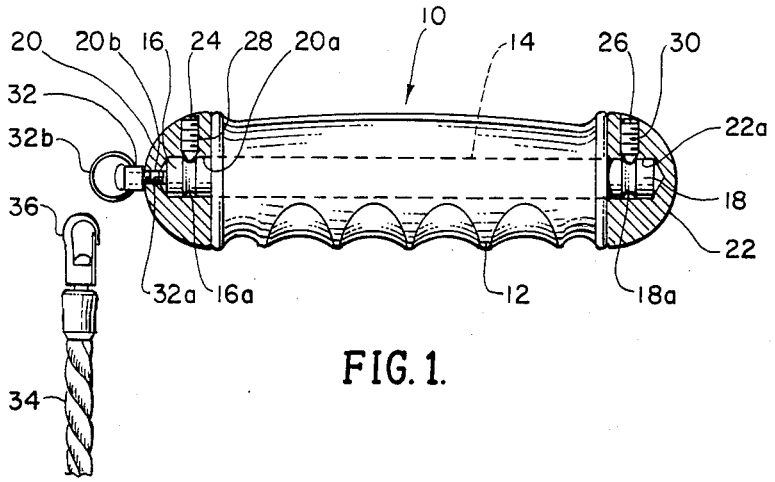
FIG. 1 is an elevation view of the weighted jump rope handle of the exercise device of the invention.

Referring to the drawing sheet, there is shown in FIG. 1 an elevation view of the weighted jump rope handle 10 of the present invention. The handle 10 is provided with a central handle grip member 12 having an orthopedic gripping configuration conforming generally to the user's palm and finger grip profile. Centrally disposed within the handle grip member 12 and rotatably mounted therein) is an end-connect bar 14 which has weight-mounting ends 16 and 18 extending beyond the handle grip member 12.

As shown in FIG. 1, the weight-mounting ends 16 and 18 of the end-connect bar are provided with end weight connect means comprising, respectively, grooves 16*a* and 18*a*. End weights 20 and 22 of equal size and weight distribution are removably mounted to the respective ends 16 and 18 of the connect bar 14 through seating cavities 20*a* and 22*a*, respectively. The end weights 20 and 22 are maintained in seated connection with the bar ends 16 and 18 by set screws 24 and 26 which extend through holes 28 and 30 of the end weights 20 and 22 and engage grooves 16*a* and 18*a* of the connect bar ends 16 and 18.

End weights 20 is provided with a swivel connector 32 mounted to such weight by stem 32*a* which is threaded into hole 20*b* of end weight 20. The swivel connector 32 is provided with loop 32*b*. A jump rope 34 bears a swivel hook 36 at each of its ends for snap-on, tangle-free connection to the swivel loop 32*b* of each weighted handle 10.

The jump rope, weighted handle, exercise device of the invention is provided with a series of pairs of end weights 20 and 22 of varying weight. Thus, a series of end weights 20 and 22 may include one pound increasing increments of weight whereby each jump rope handle is increased by two pounds of weight with each change of end weights in the series. If the series of end weights advances in one-half pound increments the weight of each handle increases by one pound with each change of end weights in the series.

Figure 2:
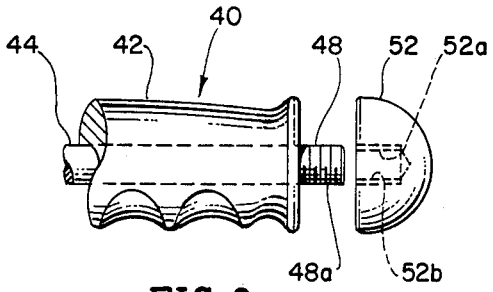
FIG. 2 is a partial exploded view of an alternative form of the weighted Jump rope handle of the invention.

In FIG. 2 there is shown an alternative means for removably connecting the end weights to the connect bar of the handle assembly. Thus, in a handle assembly 40, including a handle grip member 42, the end connect bar 44 with weight-mounting end 48 bears mounting threads 48*a* and connects with end weight 52 through engagement with internal threads 52*a* of weight seat cavity 52*b* within weight 52.

Figure 3:
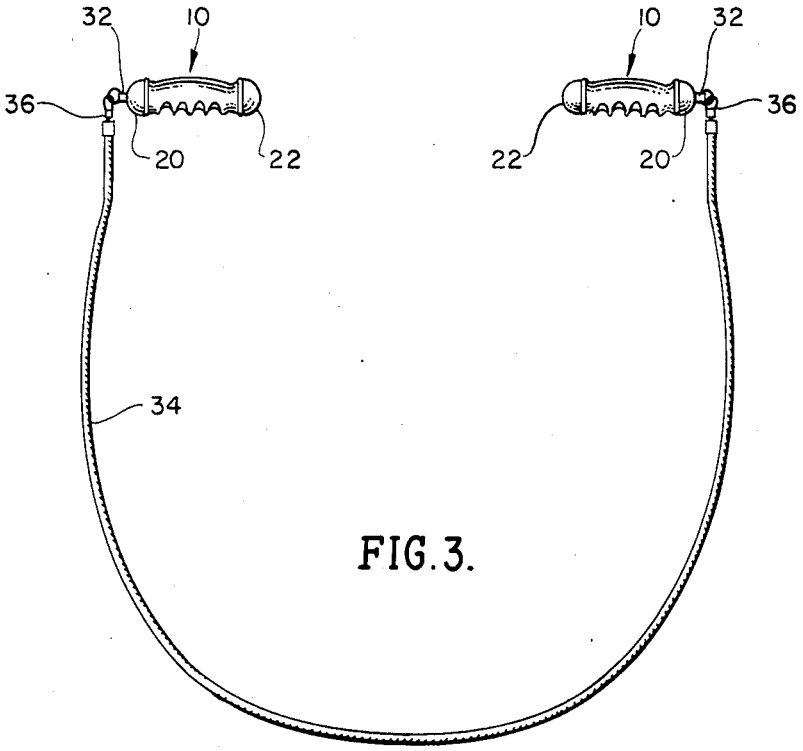
FIG. 3 is a view of a jump rope exercise device with the weighted handles of the present invention connected to the rope.

FIG. 3 presents an overall view of a jump or skip rope exercise device with the rope loop 34 connected to the variable weight handles 10 of the present invention. Employment of an exercise conditioning program including use of the weighted-handle jump rope of the disclosed design will provide the user with substantial exercise and muscle-building benefits. The skipping exercise is particularly beneficial in developing coordination between the hand-arm system and the foot-leg systems, improved breathing performance, and heart rate development. The weight provided by the weight handles is balanced between the forward and rearward ends of each rope handle and is transferred from the hands through the wrists and arms to the entire body for the controlled and incremental development of body strength and endurance.

The removably mounted rope handle weights of the present invention are smoothly contoured and are free of projections. The weight of each handle is distributed equally between the forward and rearward ends of the handles and there is no shift of the weight distribution as in the case of weighted jump rope handles that contain a fluid. The handles of the invention are particularly adaptable for use in a vigorous jump rope exercise program without risk of injury and such variable weight handles are compatable with the beginning and developing strength program of each user.

While several particular embodiments of this invention have been described above, it will be understood that the invention is not to be limited thereto and the invention may be embodied in other specific forms without departing from the spirit or essential characteristics thereof. The presented embodiments are therefore to be considered as illustrative only and not restrictive, the scope of the invention being indicated by the appended claims.

What is claimed is:

1. A jump rope exercise system including two like variable-weight handle assemblies interconnected by a jump rope with each variable-weight handle assembly comprised of: a handle grip member; an end-connect bar of uniformly circular cross-section rotatably mounted and axially aligned within said handle grip member, said end-connect bar having end portions extending from the ends of said grip member; and handle assembly end weight members of like selective weight, said end members being removably mounted to the end portions of said end-connect bar for uniform end-to-end weighting thereof and for maintaining said grip member thereon, one of said end members including swivel means for connection of the variable-weight handle assembly to an end of the jump rope.

2. The jump rope exercise system including a jump rope connected at each end to a variable weight handle assembly according to claim 1 wherein the like end weight members are mounted to the end portions of said end-connect bar by set screws extending radially through the end weight members into gripping contact with said end portions.

3. The jump rope exercise system including two like variable-weight handle assemblies interconnected by a jump rope with each variable-weight handle assembly according to claim 1 wherein the handle assembly end weight members of like selective weight are mounted to the end portions of said end-connect bar by threaded engagement therewith.

4. A jump rope exercise system including two like variable-weight handle assemblies interconnected by a jump rope with each variable-weight handle assembly comprised of: a handle grip member of orthopedic configuration conforming to the profile of a closed gripping hand of a user of the exercise system; an end-connect bar of uniformly circular cross-section rotatably mounted and axially aligned within said handle grip member, said end-connect bar having end portions extending from the ends of said grip member; and handle assembly end weight members of like selective weight, said end members being removably mounted to the end portions of said end-connect bar for uniform end-to-end weighting thereof and for maintaining said grip member thereon, one of said end members including swivel means for connection of the variable-weight handle assembly to an end of the jump rope.

* * * * *